US005368225A

United States Patent [19]

Ritter

[11] Patent Number: 5,368,225

[45] Date of Patent: Nov. 29, 1994

[54] CONTAINER WITH TRUNCATED CORNERS

[75] Inventor: Karl M. Ritter, Wheaton, Ill.

[73] Assignee: Jefferson Smurfit Corp., Clayton, Mo.

[21] Appl. No.: 167,214

[22] Filed: Dec. 16, 1993

[51] Int. Cl.[5] ..... B65D 5/24

[52] U.S. Cl. ..... 229/110; 229/144; 229/149; 229/186; 229/906

[58] Field of Search ..... 229/109, 110, 144, 149, 229/150, 151, 186, 902, 906

[56] References Cited

U.S. PATENT DOCUMENTS

| | | | |
|---|---|---|---|
| 2,189,151 | 2/1940 | Platt | 229/906 |
| 2,973,858 | 3/1961 | Laneve et al. | 229/149 |
| 3,162,142 | 3/1964 | Goetz | 229/186 |
| 4,765,534 | 8/1988 | Zion et al. | 229/906 |
| 4,809,908 | 3/1989 | Keefe et al. | 229/150 |
| 4,984,734 | 1/1991 | Zion et al. | 229/109 |
| 5,000,374 | 3/1991 | Deiger | 229/906 |
| 5,110,039 | 5/1992 | Philips | 229/110 |
| 5,118,032 | 6/1992 | Geho | 229/110 |
| 5,211,329 | 5/1993 | Patton | 229/110 |
| 5,263,634 | 11/1993 | Korine | 229/109 |

FOREIGN PATENT DOCUMENTS

| | | | |
|---|---|---|---|
| 3933372 | 4/1991 | Germany | 229/109 |

*Primary Examiner*—Gary E. Elkins
*Attorney, Agent, or Firm*—Richard W. Carpenter

[57] ABSTRACT

A one-piece, collapsible, tray type, paperboard container with one or more truncated corners, each of which includes a pair of vertical side walls, with adjacent ends spaced from each other and interconnected by a three-piece gusset. The gusset includes first and second sections, foldably joined to each of the side walls, and a corner section, foldably joined to each side section. The corner section is folded in face-to-face relation with one of the side sections and positioned against an inner surface of one of side walls in interlocking engagement therewith.

20 Claims, 2 Drawing Sheets

CONTAINER WITH TRUNCATED CORNERS

BACKGROUND OF THE INVENTION

1. Field of the Invention

This invention relates to tray type containers and, more particularly, to an improved corner arrangement for a tray type container with truncated corners.

2. Description of the Background Art

A background art search directed to the subject matter of this invention conducted in the United States Patent and Trademark Office disclosed the following United States Letters Patent: U.S. Pat. Nos. 4,765,534, 5,110,039, 5,211,329.

None of the patents uncovered in the search discloses a one-piece, collapsible, tray type, paperboard container with one or more truncated corners, each including a pair of side wall panels, with adjacent ends spaced from each other and interconnected by a three-piece gusset including first and second sections, foldably joined to respective side wall panels, and a corner section, foldably joined to respective side sections, and which is folded in face-to-face relation with one of the side sections and interlocked with a retaining flap on one of the side wall panels.

SUMMARY OF THE INVENTION

It is a primary object of the invention to provide a collapsible, tray type container, having one or more truncated corners, and which is formed from a unitary blank of foldable paperboard.

Another object of the invention is the provision of a container of the type described wherein the front wall has an interlocking connection with the side walls, but which can be easily and quickly erected manually.

A more specific object of the invention is to provide a tray type container with truncated front corners wherein the front and side wall panels are interconnected by a three section gusset member, a portion of which has interlocking engagement with a front wall retaining flap.

These and other objects of the invention will be apparent from an examination of the following description and drawings.

It will be understood that, for purposes of clarity, certain elements may have been omitted from certain views where they are believed to be illustrated to better advantage in other views.

DESCRIPTION OF THE PREFERRED EMBODIMENT

Figure 1:
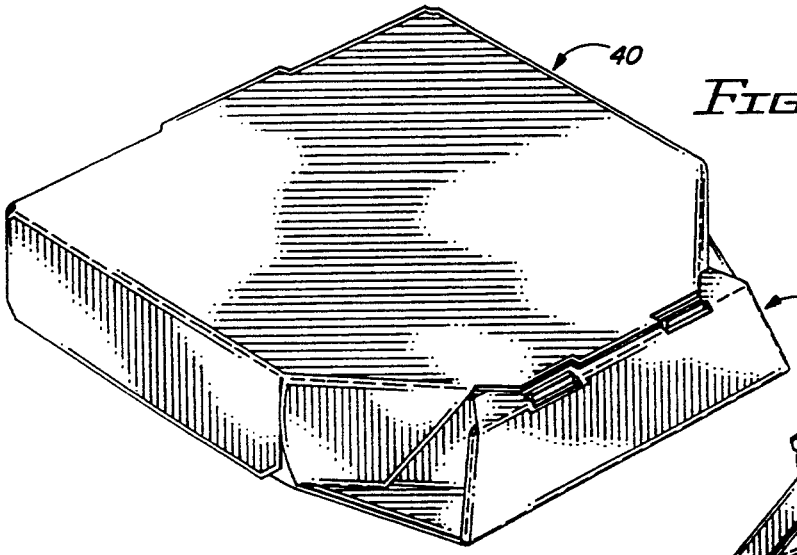
FIG. 1 is an isometric view of a tray type container embodying features of the present invention, shown in a closed condition.
Figure 3:
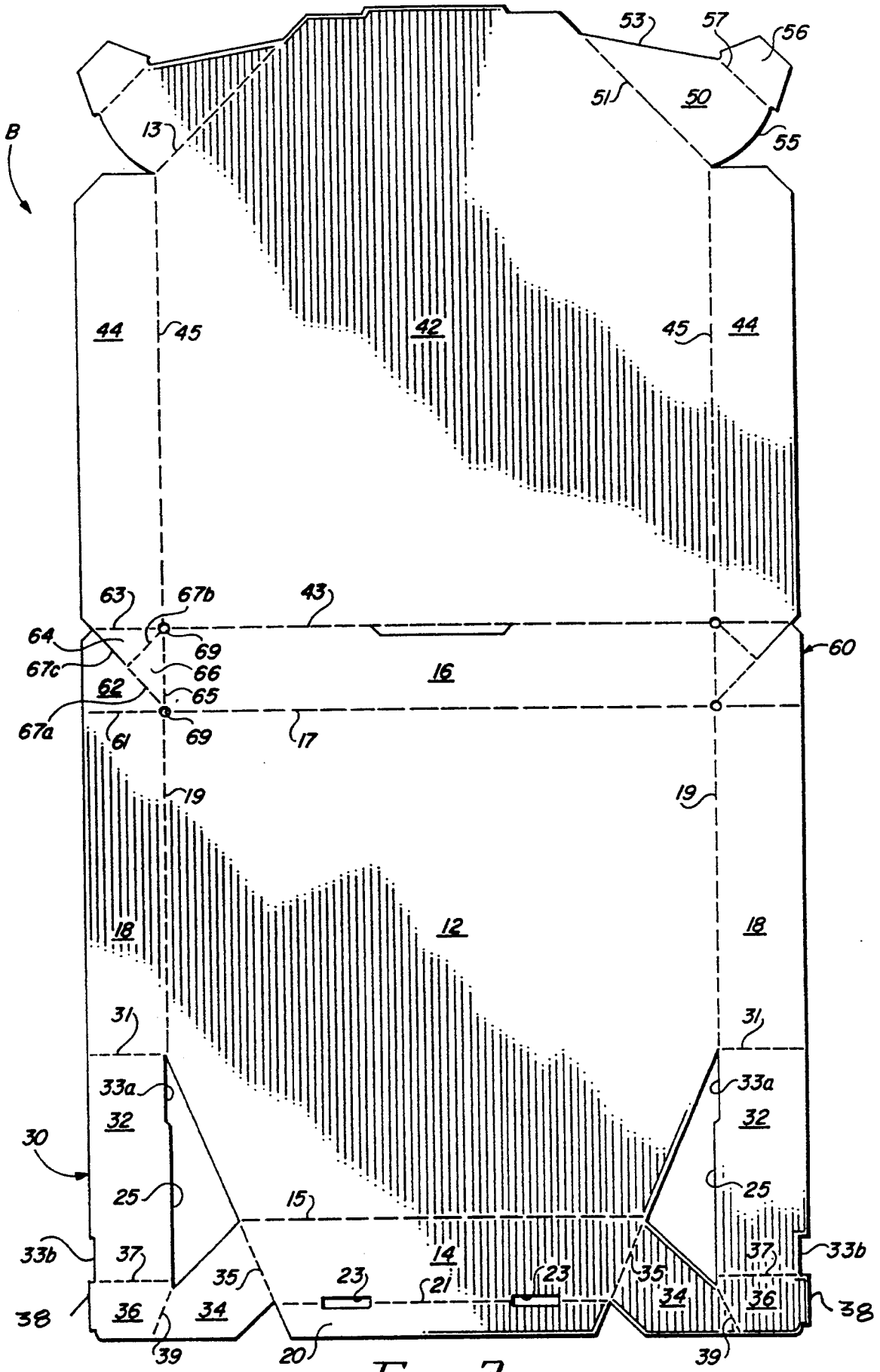
FIG. 3 is a plan view of the blank of sheet material used to form the container illustrated in the other views.

Referring now to the drawings for a better understanding of the invention, it will be seen that the tray type container, embodying features of the invention and indicated generally at C in FIG. 1, may be formed from the unitary blank of foldable paperboard indicated generally at B in FIG. 3.

Although container C, as illustrated in the drawings of this application, includes both a tray 10 and an integral cover 40, the essential feature of the present invention resides in the novel construction of the truncated corners of the tray, as hereinafter described. Thus, it should be understood that the tray illustrated and described herein, may be formed with or without a cover or lid.

Figure 2D:
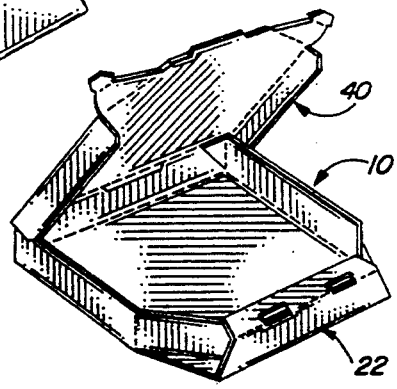
FIGS. 2A–2F are isometric views illustrating the sequential steps required to erect the container illustrated in FIG. 1.
Figure 2A:
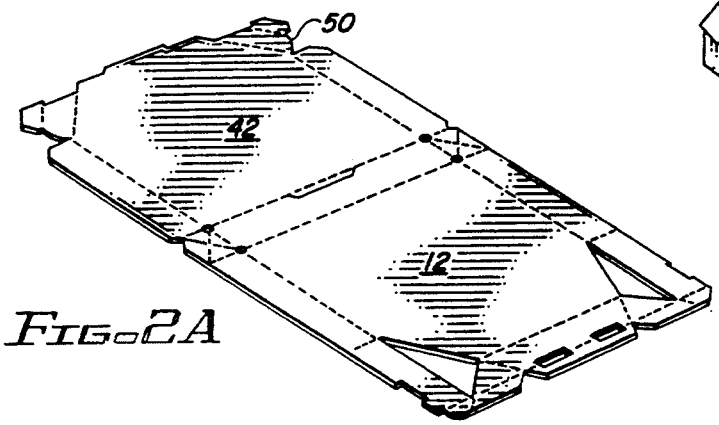
Figure 2B:
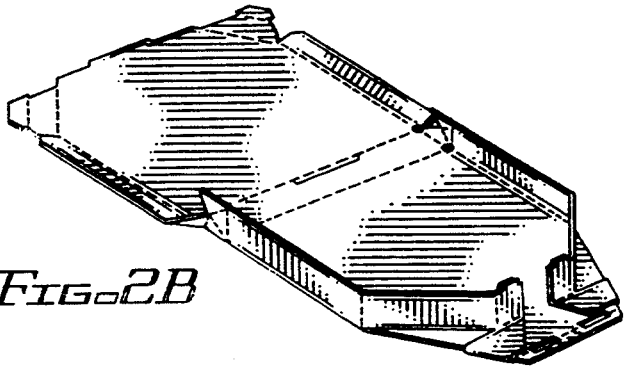
Figure 2E:
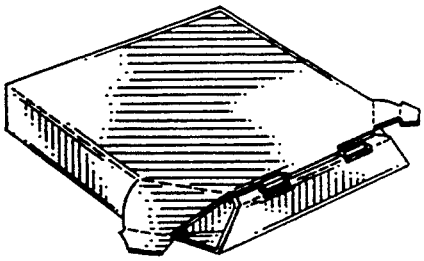
Figure 2C:
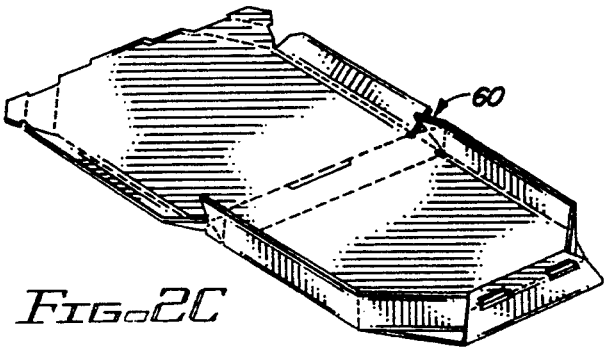
Figure 2F:
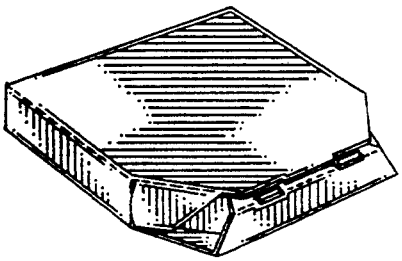

As best seen in FIG. 2B, tray 10 includes a hexagonal bottom wall panel 12 with a front wall panel 14 and a rear wall panel 16 foldably joined to front and rear edges along fold lines 15 and 17, respectively; and a pair of side wall panels 18, foldably joined to opposed side edges thereof along fold lines 19. Panel 12 has a pair of truncated front corners defined by diagonal edges 13.

A retaining flap 20 is foldably joined to front wall panel 14 along fold line 21 to form an L-shaped front wall 22. Again referring to FIG. 3, it will be seen that portions of the front wall retaining flap are cut out to provide a pair of lock tab receiving recesses 23, located adjacent fold line 21.

As best seen in FIGS. 2A and 3, the front ends of the tray side wall panels are spaced from the adjacent ends of the front wall panel but are connected thereto by unique three-section gussets, indicated generally at 30.

It will be seen that the gussets are each generally V-shaped, with inboard edges separated from adjacent front corner edges 13 of the tray bottom wall panel 12 to define an opening 25 therebetween.

Each gusset 30 includes a first or side section 32, foldably joined along a fold line 31, to a front edge of tray said wall panel 18; a second or front section 34, foldably joined along a fold line 35, to a side edge of tray front wall panel 14; and a third or corner section 36, foldably joined along a fold line 37 to first section 32, and foldably joined along a fold line 39 to second section 34.

The lower edge of each first section 32 may be recessed, as indicated at **33*a*, for receipt of a locking tab, and the upper edge may be recessed, as at 33*b*, for receipt of a portion of front wall retaining flap 20**, as hereinafter described.

Each gusset third section may be provided, at its upper edge, with a projection 38 that serves as a lock tab which is receivable within an opening 23 in the tray front wall retaining flap 20 to provide an interlocking connection between the tray side wall panel and the front wall, as hereinafter described.

As previously mentioned, the tray of the present invention may be formed with any type of cover, or without a cover. In this application tray 10 is illustrated with a cover indicated at 40.

As seen in FIGS. 2D and 3, cover 40 includes a top wall panel 42, foldably joined along fold line 43 to the upper edge of tray rear wall panel 16; and a pair of side wall panels, 44 foldably joined along fold lines 45, to opposed side edges of top wall panel 42.

Cover 40 includes a pair of locking flaps 50, foldably joined, on fold lines 51, to front corner edges of cover top wall panel 42. As seen in FIG. 3, each locking flap 50 has a straight side edge 53 and a curved side edge 55. A locking tab 56 is foldably joined, on a fold line 57, to the outer end of locking flap 50.

Although the tray side wall panels may be connected to the tray rear wall panel in different ways, in this application the tray side wall panels 18 are shown connected to the tray rear wall panel 16 by a pair of unique webs, indicated generally at 60.

Each web 60, includes three triangular sections: a first section 62, foldably joined on a fold line 61 to a related tray side wall panel 18; a second section 64, foldably joined on a fold line 63 to a related cover side wall panel 44; and a third section 66, foldably joined on a fold line 65 to tray rear wall panel 16.

Web third section 66 is also foldably joined along fold lines 67*a* and 67*b* to adjacent edges of web first and second sections 62 and 64, respectively. Also, web first section is separated from web second section by a cut line 67*c*.

To facilitate folding of the web sections on closure of the cover, a pair of openings may be provided in blank B at opposite ends of fold lines 65, where they intersect fold lines 61 and 63.

In order to erect the tray, the front wall panel 14 and the side wall panels 18 are folded upwardly from the bottom wall panel. At the same time gusset second and third sections 34 and 36 are folded inwardly until second section 34 lies against the inner or rear surface of front wall panel 14, and third section 36 lies against portions of the inner or rear surfaces of both second section 34 and front wall panel 14. As this occurs gusset first sections 32 are folded inwardly to lie over the front corners of tray bottom wall panel 12 inboardly of diagonal corner edges 13.

At this time tray front wall retaining flap 20 is folded inwardly 90 degrees with the gusset third section lock tabs being engaged in the respective front wall recesses 23, and the ends of the retaining flap being received within the respective gusset first section recesses 33*b*.

In order to close the container cover, after the container has been filled, the tray rear wall panel 16 is folded to the vertical position. As this occurs the webs 60 interconnecting the tray rear and side wall panels will automatically move inwardly with the web second and third sections 64 and 66 lying in face-to-face relation with each other between the web first section 62 and the tray rear wall panel 16.

The cover can then be locked to the tray by folding the locking flaps 50 downwardly and folding the locking tabs 56 inwardly and inserting them under the respective gusset first sections 32 in related recesses 33*a*.

What is claimed is:

1. A container tray with at least one truncated corner, said tray being formed from a unitary blank of foldable sheet material, comprising:

(a) a bottom wall panel having a pair of side edges (first and second), extending normal to each other, and a corner edge extending diagonally between adjacent ends of said first and second side edges;

(b) a first side wall panel and a second side wall panel foldably joined to said bottom wall panel first and second side edges, respectively, and extending upwardly therefrom;

(c) a second side wall retaining flap foldably joined to an upper edge of said second side wall panel and folded inwardly therefrom to form therewith an L-shaped front wall;

(d) said first side wall panel being connected to said second side wall panel by a gusset, which includes:

(i) a first section having a first end edge, foldably joined to an adjacent end edge of said first side wall panel, and said first section also having a second end edge;

(ii) a second section having a first end edge, foldably joined to an adjacent end edge of said second side wall panel, and said second section also having a second end edge;

(iii) a corner section having adjacent side edges foldably joined to adjacent second end edges of respective first and second gusset sections;

(e) said gusset first section being folded inwardly to extend generally parallel to said bottom wall panel corner edge;

(f) said gusset second section and corner section being folded to lie in face-to-face relation with each other against an inner side of said second side wall panel;

(g) said gusset corner section including a portion projecting upwardly therefrom for engagement with an opening in said second side wall retaining flap to provide interlocking engagement between said first side wall panel and said second side wall.

2. A container tray according to claim 1, and including:

(a) a rear wall panel foldably joined, at a lower edge, to a rear edge of said bottom wall panel;

(b) a cover including a top wall panel foldably joined, at a rear edge, to an upper edge of said tray rear wall panel;

(c) a locking flap foldably joined, at an upper edge, to a diagonal front corner edge of said cover top wall panel and having a locking tab portion adapted to be tucked between an upper surface of said tray bottom wall panel and a lower edge of said gusset first section, when said cover top wall is in a closed position, to provide an interlocking connection between said cover and said tray.

3. A container tray according to claim 1, wherein said gusset is generally V-shaped before being folded into erected position.

4. A container tray according to claim 1, wherein said tray has two truncated front corners and has two right angled rear corners.

5. A container tray according to claim 2, wherein said gusset first section has, in a lower edge thereof, a locking tab receiving recess; and has, in an upper edge thereof, a front wall retaining flap receiving recess.

6. A container with at least one truncated corner, said container being formed from a unitary blank of foldable sheet material, and comprising:

(a) a tray including:

(i) a bottom wall panel having a pair of side edges (first and second), extending normal to each other, and a corner edge extending diagonally between adjacent ends of said first and second side edges;

(ii) a first side wall panel and a second side wall panel foldably joined to said bottom wall panel first and second side edges, respectively, and extending upwardly therefrom;

(iii) a second side wall retaining flap foldably joined to an upper edge of said second side wall panel and folded inwardly therefrom to form therewith an L-shaped second side wall;

(b) said first side wall panel being connected to said second side wall panel by a gusset, which includes:

(i) a first section having a first end edge, foldably joined to an adjacent end edge of said first side wall panel, and said first section also having a second end edge;

(ii) a second section having a first end edge, foldably joined to an adjacent end edge of said second side wall panel, and said second section also having a second end edge;

(iii) a corner section having adjacent side edges foldably joined to adjacent second end edges of respective first and second gusset sections;

(c) said gusset first section being folded inwardly to extend generally parallel to said bottom wall panel corner edge;

(d) said gusset second section and corner section being folded to lie in face-to-face relation with each other against a rear side of said second side wall panel;

(e) said gusset corner section .including a portion projecting upwardly therefrom for engagement with an opening in said second side wall to provide interlocking engagement between said first side wall panel and said second side wall;

(f) a rear wall panel foldably joined to a rear edge of said bottom wall panel and extending upwardly therefrom;

(g) a cover including:

(i) a top wall panel having a rear edge, foldably joined to an upper edge of said tray rear wall, having a pair of first and second side edges, extending normal to each other, and having a corner edge extending diagonally between adjacent ends of said first and second side edges;

(ii) a locking flap foldably joined, at one end edge, to said top wall panel corner edge and including a tab portion adapted to be tucked between an upper surface of said tray bottom wall panel and a lower edge of said tray gusset first section, when said cover is in a closed position, to interlock said cover and tray.

7. A container according to claim 6, wherein said gusset is generally V-shaped before being folded into erected position.

8. A container according to claim 6, wherein said tray and said cover each have two truncated front corners and two right angled rear corners.

9. A container according to claim 6, wherein said gusset first section has, in a lower edge thereof, a locking tab receiving recess; and has, in an upper edge thereof, a front wall retaining flap receiving recess.

10. A unitary blank of foldable sheet material, which has been cut and scored to form a container tray with at least one truncated corner, said blank comprising:

(a) a bottom wall panel having a pair of side edges (first and second), extending normal to each other, and a corner edge extending diagonally between adjacent ends of said first and second side edges;

(b) a first side wall panel and a second side wall panel foldably joined to said bottom wall panel first and second side edges, respectively;

(c) a second side wall retaining flap foldably joined to an outboard edge of said second side wall panel;

(d) said second side wall retaining flap having a lock tab receiving opening extending therethrough;

(e) said first side wall panel being connected to said second side wall panel by a gusset, which includes:

(i) a first section having a first end edge, foldably joined to an adjacent end edge of said first side wall panel, and said first section also having a second end edge;

(ii) a second section having a first end edge, foldably joined to an adjacent end edge of said second side wall panel, and said second section also having a second end edge;

(iii) a corner section including a panel having adjacent side edges foldably joined to adjacent second end edges of respective first and second gusset sections and having a lock tab projecting from another side edge thereof.

11. A blank according to claim 10, wherein said gusset is generally V-shaped.

12. A blank according to claim 10, wherein said tray bottom wall panel has two truncated front corners and two right angled rear corners.

13. A blank according to claim 10, wherein said gusset corner section is aligned with said gusset first section and is offset from said gusset second section.

14. A blank according to claim 10, wherein said tray bottom wall panel and said gusset sections have adjacent edges that define a generally triangular opening therebetween.

15. A blank according to claim 10, and including a cover forming portion, comprising:

(a) a rear wall panel foldably joined, at an inboard edge, to an outboard edge of said bottom wall panel;

(b) a cover top wall panel foldably joined, at an inboard edge, to an outboard edge of said tray rear wall panel.

16. A blank according to claim 15, and including locking flap foldably joined, at an upper edge, to a diagonal corner edge of said cover top wall panel and having a locking tab portion adapted to be tucked between an upper surface of said tray bottom wall panel and a lower edge of said gusset first section, when said cover top wall is in a closed position, to provide an interlocking connection between said cover and said tray.

17. A blank according to claim 15, and including:

(a) a locking flap foldably joined, at an upper edge, to a diagonal corner edge of said cover top wall panel;

(b) a locking tab foldably joined to said locking flap and adapted to be tucked between an upper surface of said tray bottom wall panel and a lower edge of said gusset first section, when said cover top wall is in a closed position, to provide an interlocking connection between said cover and said tray.

18. A blank according to claim 10, wherein said gusset first section has, in an inboard edge thereof, a locking flap receiving recess.

19. A blank according to claim 10, wherein said gusset first section has, in an outboard edge thereof, a front wall retaining flap receiving recess.

20. A blank according to claim 10, wherein said gusset first section has, in an inboard edge thereof, a locking tab receiving recess; and has, in an outboard edge thereof, a front wall retaining flap receiving recess.

* * * * *